US009542831B2

(12) United States Patent
Butalla, III

(10) Patent No.: US 9,542,831 B2
(45) Date of Patent: Jan. 10, 2017

(54) AUDIBLE/VISIBLE EVACUATION NOTIFICATION DEVICE

(71) Applicant: Honeywell International Inc., Morristown, NJ (US)

(72) Inventor: Fred M. Butalla, III, Joliet, IL (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 37 days.

(21) Appl. No.: 14/577,536

(22) Filed: Dec. 19, 2014

(65) Prior Publication Data

US 2016/0180700 A1 Jun. 23, 2016

(51) Int. Cl.
*G08B 29/00* (2006.01)
*G08B 29/12* (2006.01)

(52) U.S. Cl.
CPC ..... *G08B 29/12* (2013.01)

(58) Field of Classification Search
CPC ..... G08B 29/00
USPC ..... 340/514, 517, 628, 629, 630
See application file for complete search history.

(56) References Cited

U.S. PATENT DOCUMENTS

| | | | | |
|---|---|---|---|---|
| 5,598,139 | A | 1/1997 | Karim et al. | |
| 5,705,979 | A * | 1/1998 | Fierro | G08B 29/145 340/506 |
| 6,313,744 | B1 | 11/2001 | Capowski et al. | |
| 8,446,285 | B2 * | 5/2013 | Lontka | G08B 29/123 340/501 |
| 8,760,280 | B2 * | 6/2014 | Piccolo, III | G08B 17/00 307/117 |
| 8,860,387 | B2 * | 10/2014 | Kobayashi | H02M 3/1582 323/259 |
| 2004/0090325 | A1 * | 5/2004 | Tanguay | G08B 3/10 340/514 |
| 2014/0266675 | A1 | 9/2014 | Piccolo, III et al. | |
| 2014/0266676 | A1 | 9/2014 | Piccolo, III et al. | |
| 2014/0266677 | A1 | 9/2014 | Piccolo, III et al. | |

* cited by examiner

*Primary Examiner* — Toan N Pham
(74) *Attorney, Agent, or Firm* — Husch Blackwell LLP

(57) ABSTRACT

An output device emits alarm indicating light and sound at predetermined levels when activated. The device enters a test mode in response to received test mode indicating control signals. When the device is in the test mode and a local test initiating control signal is received, audio and/or visual outputs are emitted at a level reduced from the alarm indicating output levels to test those outputs.

18 Claims, 3 Drawing Sheets

AUDIBLE/VISIBLE EVACUATION NOTIFICATION DEVICE

FIELD

The application pertains to audible and/or visible alarm indicating output devices. More particularly, the application pertains to such devices that provide for un-intrusive testing of the audible and visual alarm indicating outputs.

BACKGROUND

Regular testing of a fire system is required as per NFPA72. As a part of testing a fire system, it is important to validate that the audible/visible notification appliances on the Notification Appliance Circuit (NAC) are functioning properly. However, unlike the testing of the sensors, the testing of the NAC circuit can present some unique challenges. The sensors can be tested with little disturbance to the building occupants.

Devices on a NAC circuit, on the other hand, are designed to alert individuals to a fire and therefore, are meant to cause a disturbance. Depending on the building and its occupants, this can create challenges for both the occupants as well as those doing the testing. Sometimes, testing needs to be done late at night when the building is unoccupied. Often times, those doing the testing will activate the NAC circuit and literally run through the building to validate that all units are operating. This can also be challenging to ensure that each device is sounding since the overall noise is quite loud.

There are other times when a building is always occupied, such as a factory where three shifts result in the building being occupied for 24 hours per day. In that situation, employees may have to step outside while the testing is conducted. This results in lost production for the company. Even greater challenges arise with buildings that are always occupied, such as a hospital. In this case, patients cannot be easily moved outside. They either have to put up with the noise, or, more likely, the testing is simply not done.

One system for driving and controlling such devices is disclosed in U.S. Pat. No. 5,598,139 entitled "Fire Detecting System With Synchronized Strobe Lights", which issued Jan. 28, 1997. The '139 patent is assigned to the assignee hereof and incorporated herein by reference.

DETAILED DESCRIPTION

Figure 1:
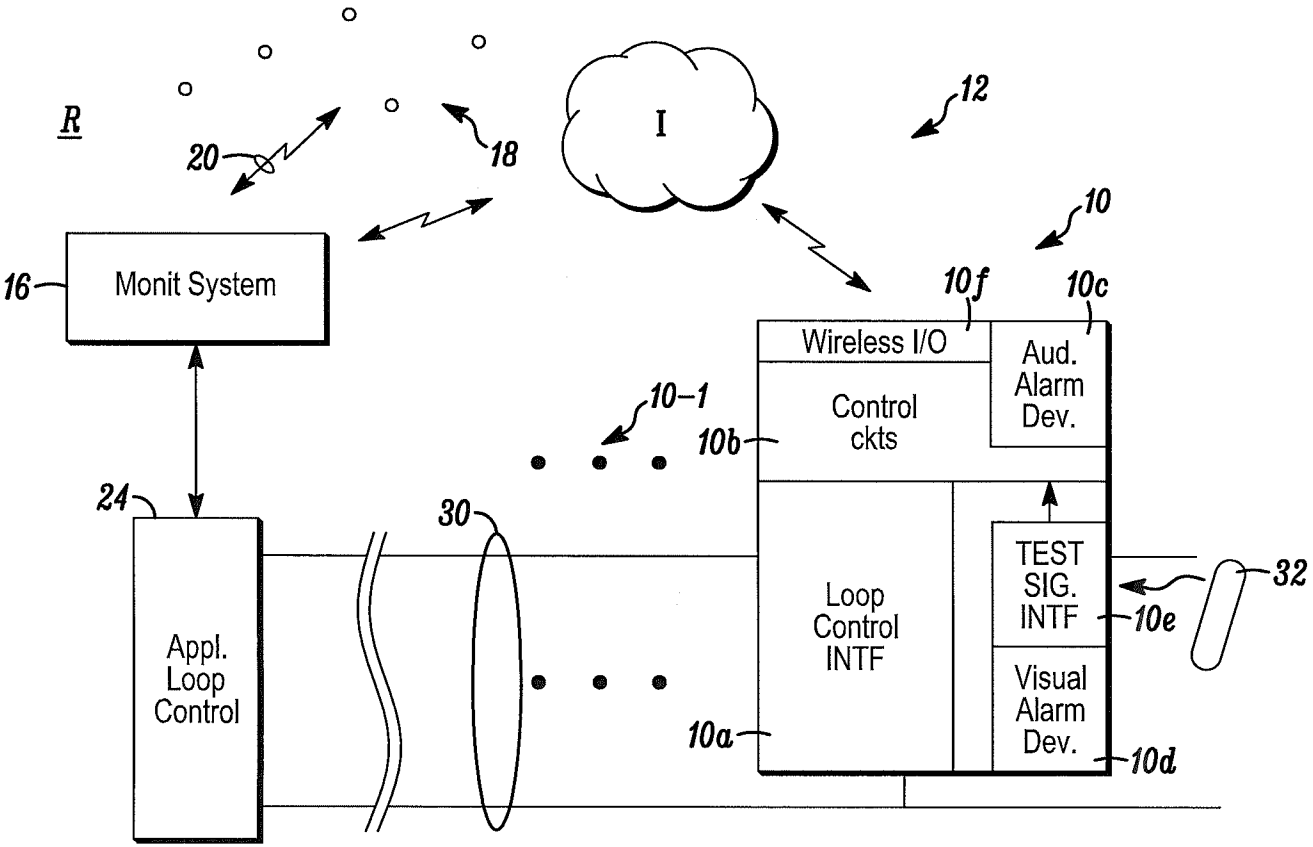
FIG. 1 illustrates a block diagram of a notification device in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

Embodiments hereof provide a method of testing individual devices on the NAC circuit instead of activating all of the devices at the same time. The NAC circuit itself would be placed into a test state by sending specific pulses on the power lines.

While the units would have power, they would not be active since they recognize the test status indicating pulses on the line. The person conducting the test would go to each device independently and hold a magnet up to the device in order to enable that particular device to flash and/or sound. When the magnet was removed, the device would return to a standby state.

The device could be programmed such that, when the magnet is sensed, the emitted intensity of the light and/or sound would be at a reduced level since the person conducting the test is directly in front of the device. This would further help to reduce the disturbance to others within the building while the test is being conducted.

Conversely, the device could, instead, be designed such that the intensity of the light and/or sound was not reduced. Alternately, the device could even be designed such that the light and/or sound level was reduced, and, if the magnet was still sensed after the first several seconds, then the device would revert to its full intensity until the magnet was removed.

This method of individual device testing would enable all devices within the system to be tested without creating a major disturbance to the occupants of the building, unlike traditional testing. In accordance herewith, only one unit needs to be active at a time. Multiple persons could be conducting tests at the same time at different parts of the building to decrease test time while still not disturbing everyone else on the premises.

FIG. 1 illustrates a notification device 10 in accordance herewith. The device 10 is illustrated as part of a larger alarm system 12. The system 12 includes a regional monitoring system 16, which communicates with a plurality of ambient condition detectors 18. The detectors 18 monitor conditions in a region R and communicate via a wired or wireless medium 20 with the monitoring system 16.

The system 16 is coupled to and in communication with an appliance loop control unit 24. As those of skill will understand, the loop control circuits 24, via a wired medium 30, can provide electrical energy and control signals to a plurality of notification appliances 10-1. The appliance 10 is representative of other members of the plurality 10-1 and a discussion of the appliance 10 will also apply to other members of the plurality 10-1.

The appliance 10 includes a loop control interface 10*a*, which is coupled to the loop 30 and to the control circuits 10*b*. The control circuits 10*b* are, in turn, coupled to an audible alarm indicating output device 10*c*, a visual alarm indicating output device 10*d*, and a local test signal receiving interface 10*e*. The appliance 10 can be internet enabled and include a wireless I/O interface 10*f*.

Fire panels, such as the system 16, and power supplies, such as the appliance loop control unit 24, can provide synchronization signals by dropping the power supply to the NAC, via the medium 30 and the plurality 10-1, to zero volts for a known amount of time.

Within the notification appliance, there is circuitry 10*a* to sense this dropout and measure its duration. If the pulse is too short or too long, then it is ignored. Since this circuitry is available, a test mode control signal can be implemented as a dropout pulse of a unique duration on the medium 30. This pulse can be sent at a specified period so that, if the pulse is no longer sensed, then the device 10 will revert back to a normal operation mode. This is a fail safe solution so that the device is not inoperable during an actual emergency.

On the device 10 and other members of the plurality 10-1, the same circuitry, such as 10*a*, that monitors the synchronization pulses on the medium 30 can be used to detect the test mode pulses. The circuitry measures the voltage level on the NAC lines 30 and looks for the voltage level to drop below a defined threshold, best illustrated in FIG. 3. Once the voltage level reaches that threshold, the circuitry also measures the duration.

If both voltage and duration are valid, then the device 10 enters a standby mode in which the device 10 awaits the presence of a local test initiating signal initiated by the device 32. The device 32 can include a magnet. The magnet can be sensed with either a reed switch or a hall effect switch in the test signal interface 10*e*. A magnet is not necessary. A push button or other type of switch could also be used, but a magnetic switch is cost effective and will not impact the aesthetics of the device.

Alternately, the device 32 can generate a test initiating command via an emitted light beam, an acoustic output, or RF-type signals directed at and received by the interface 10*e*. In summary, in the presence of a test mode initiated by a signal on the medium 30 and a locally generated test initiating signal from unit 32, the appliance 10 will emit one or both of a test indicating audible output and/or an optical visible light output.

The emitted test indicating audible and visual outputs from the units 10*c* and 10*d* exhibit a level or intensity less than a corresponding alarm indicating output.

Figure 2:
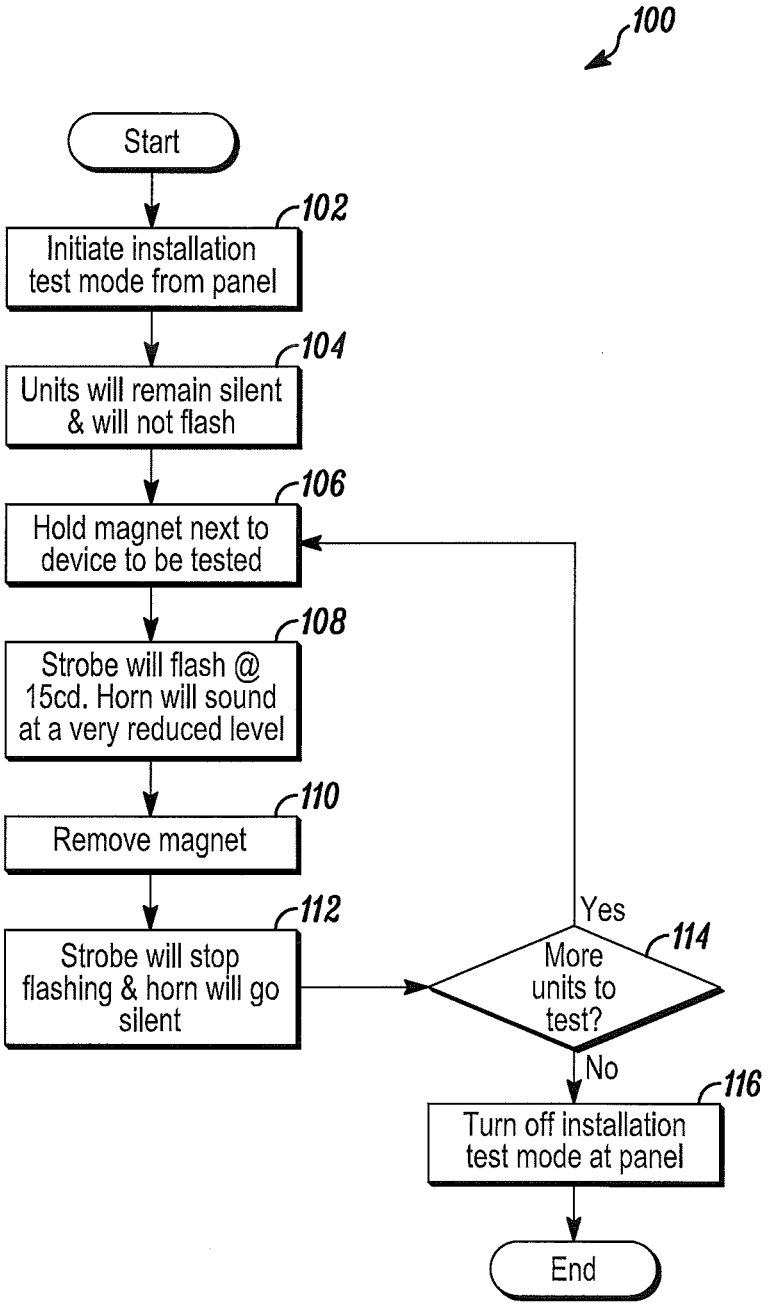
FIG. 2 is a flow diagram of a method in accordance herewith.

FIG. 2 illustrates as an embodiment hereof: a process 100. An installation test mode can be initiated at the monitoring system panel 16, which can energize the loop control unit 24 to emit a test mode command signal as in FIG. 3. Members of the plurality 10-1 react to the test mode control pulses by remaining silent, without audible or visual output, as at 104. As discussed above, a local test initiating control signal from the element 32 causes the members of the plurality 10-1 to emit one or both of a test indicating audible output, from the output device 10*c*, and/or a test indicating optical output, from the output device 10*d*, as at 108.

Subsequently, the local control signal is removed as at 110. In response thereto, the audible output device 10*c* and the visual output device 10*d* will stop emitting respective outputs as at 112.

If there are more units to test as at 114, then the above process is repeated. If not, then the installation test mode is turned off at the panel 16 and the loop control circuits 24 as at 116.

Figure 3:
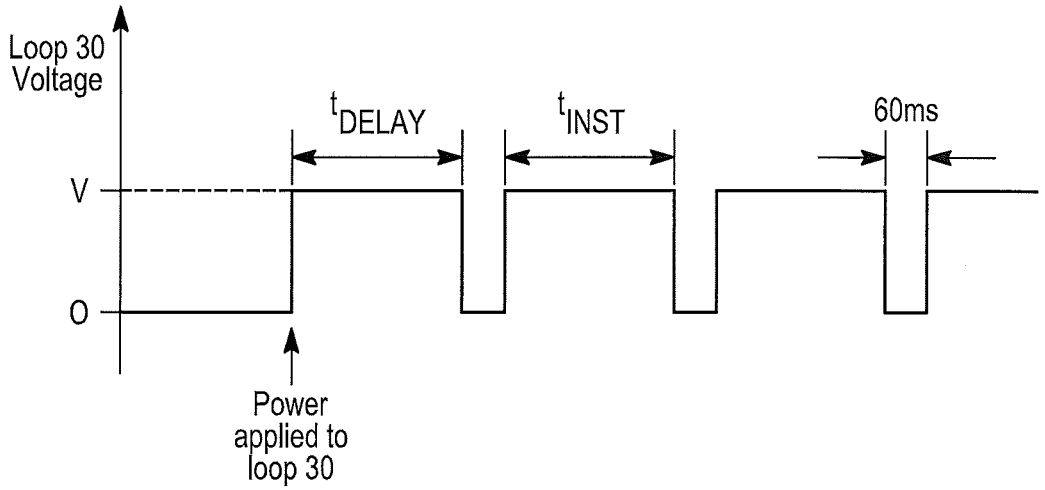
FIG. 3 illustrates a timing diagram in accordance herewith.

FIG. 3 illustrates a representative timing diagram of pulses from the loop control circuitry 24 received by the members of the plurality 10-1, which place those units into an installation test mode as at 102.

Those of skill will understand that additional variations come within the scope and spirit hereof. For example, the installation test mode command signals, discussed above in connection with the loop 30, can be transmitted via a computer network I, such as the internet, to the members of the plurality 10-1. When the local signal source 32 is cause to generate the local test initiation signal for an extended period of time, the audible alarm device and the visual alarm device can emit at predetermined alarm indicating levels instead of reduced test indicating levels.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided or steps may be eliminated from the described flows, and other components may be added to or removed from the described embodiments.

The invention claimed is:

1. A test method comprising:

receiving a test mode indicating signal, wherein a duration and amplitude of the test mode indicating control signal determines whether a unit being tested should enter a test mode;

initiating the test mode at an alarm indicating output device, wherein the test mode includes entering a standby mode;

the alarm indicating output device remaining silent in response to the test mode;

providing a local test activating input to the alarm indicating output device; and responding to both the test mode and the local test activating input by outputting at least one local test indicating indicium.

2. The method as in claim 1 wherein the outputting the at least one local test indicating indicium includes one of generating an audio test output or generating a visual test output.

3. The method as in claim 1 further comprising establishing at least one of an alarm indicating audio output or an alarm indicating visual output, wherein the outputting the at least one local test indicating indicium includes one of generating an audio test output or generating a visual test output.

4. The method as in claim 3 wherein responding to the local test activating input includes outputting the at least one local test indicating indicium as the audio test output at a lower audio level than when an audible alarm is generated.

5. The method as in claim 4 wherein the lower audio level indicates proper operation of an alarm indicating audio output element of the unit being tested.

6. The method as in claim 3 wherein responding to the local test activating input includes outputting the at least one local test indicating indicium as the visual test output at a lower candela level than when a visual alarm indicating indicium is generated.

7. The method as in claim 6 wherein the lower candela level indicates proper operation of a visual alarm indicating output element of the unit being tested.

8. The method as in claim 3 wherein providing the local test activating input includes providing at least one of an optical, magnetic, acoustic, or RF-type test activating input.

9. The method as in claim 8 further comprising providing a portable device and communicating the local test activating input from the portable device to the unit being tested.

10. The method as in claim 9 wherein communicating the local test activating input from the portable device includes at least one of providing a magnet and a magnetic field adjacent to the unit being tested, and transmitting a visual, audible, or RF-type signal from a communications device to the unit being tested.

11. The method as in claim 1 further comprising providing a plurality of units to be tested.

12. A testable output device comprising:

a housing;

an audio output device carried by the housing;

control circuits coupled to the audio output device and carried by the housing, wherein the control circuits respond to a test mode indicating signal without activating the audio output device; and test circuits coupled to the control circuits to respond to a local test initiator, wherein, responsive to the local test initiator, the control circuits activate the audio output device to output an audio test indicium, wherein the control circuits respond to a duration and amplitude of the test mode indicating signal and enter a standby mode, and wherein, when the test circuits receive the local test initiator, the control circuits activate the audio output device to output the audio test indicium.

13. The output device as in claim 12 further comprising a test and alarm indicating optical output device carried by the housing that emits a visual test indicator.

14. The output device as in claim 13 wherein the test circuits respond to at least one of a manual input, a magnetic input, an RF-type input, an optical input, or an acoustic input.

15. The output device as in claim 12 wherein the control circuits respond to a pulse of a selected duration to establish the test mode.

16. The output device as in claim 15 wherein the control circuits remain in the test mode substantially constantly in a presence of a train of pulses, each of the train of pulses having the selected duration.

17. The output device as in claim 12 wherein the test circuits respond to at least one of a manual input, a magnetic input, an RF-type input, an optical input, or an acoustic input.

18. An output device comprising;

test circuits;

a light source;

an audible source; and control circuits coupled to the light source and the audible source and configured to activate the light source or the audible source in response to predetermined control signals, wherein alarm indicating light is emitted by the light source and audio is emitted from the audible source at predetermined alarm indicating levels when activated, wherein the output device enters a test mode in response to received test mode indicating control signals, and wherein, when the output device is in the test mode, and when a local test initiating signal is received, at least one of light and/or audio outputs are emitted at a level reduced from the predetermined alarm indicating levels to test the light and/or audio outputs, wherein the control circuits respond to a duration and amplitude of the test mode indicating control signals and enter a standby mode, and wherein, when the local test initiating signal is received, the control circuits activate at least one of the audible source and the light source.

* * * * *